US006908420B2

(12) United States Patent
Zaoralek et al.

(10) Patent No.: US 6,908,420 B2
(45) Date of Patent: Jun. 21, 2005

(54) DIMENSIONALLY STABILIZED ROLLER BODY

(75) Inventors: Heinz-Michael Zaoralek, Königsbronn (DE); Jürgen Krüger, Aalen (DE)

(73) Assignee: Schwäbische Hüttenwerke GmbH, Aalen-Wasseralfingen (DE)

( * ) Notice: Subject to any disclaimer, the term of this patent is extended or adjusted under 35 U.S.C. 154(b) by 0 days.

(21) Appl. No.: 10/334,322

(22) Filed: Dec. 30, 2002

(65) Prior Publication Data

US 2003/0153445 A1 Aug. 14, 2003

(30) Foreign Application Priority Data

Dec. 28, 2001 (DE) ..... 101 64 344

(51) Int. Cl.[7] ..... F16C 13/00
(52) U.S. Cl. ..... 492/58; 29/895
(58) Field of Search ..... 29/895, 895.1, 29/895.212; 492/58, 57; 72/701, 702

(56) References Cited

U.S. PATENT DOCUMENTS

| | | | | | |
|---|---|---|---|---|---|
| 322,049 | A | * | 7/1885 | Emery | 29/897.35 |
| 1,840,237 | A | * | 1/1932 | Leighton | 72/31.03 |
| 3,946,499 | A | * | 3/1976 | Schiel | 34/124 |
| 3,966,260 | A | * | 6/1976 | Braun | 301/127 |
| 4,177,088 | A | * | 12/1979 | Pierrel | 148/591 |
| 4,607,420 | A | * | 8/1986 | Vomhoff | 492/5 |
| 4,748,088 | A | * | 5/1988 | Billgren | 428/558 |
| 4,771,524 | A | * | 9/1988 | Barbezat et al. | 492/54 |
| 4,912,957 | A | * | 4/1990 | Petersen et al. | 72/389.6 |
| 5,755,156 | A | * | 5/1998 | Stein et al. | 100/331 |
| 6,317,981 | B1 | * | 11/2001 | Clive-Smith | 29/897.35 |
| 6,588,332 | B1 | * | 7/2003 | Zaoralek et al. | 100/163 R |

FOREIGN PATENT DOCUMENTS

| | | |
|---|---|---|
| DE | 33 04 076 C2 | 8/1984 |
| DE | 198 19 663 A1 | 11/1999 |
| DE | 198 28 722 C2 | 12/1999 |
| DE | 198 30 254 A1 | 1/2000 |

OTHER PUBLICATIONS

English Translation of the German Search Report from German Priority Application No. 101 64 344.6, dated Aug. 7, 2002.

E. Nechielberger, Leoben Temperature Creep and Stress Dependency of the E–module of Cast Iron Materials; Austrian Engineer's and Architect's Journa, Issue 1, vol. 130 (1985); pp. 1–36; (German language document and English–language translation portions thereof).

* cited by examiner

*Primary Examiner*—Marc Jimenez
(74) *Attorney, Agent, or Firm*—RatnerPrestia

(57) ABSTRACT

A roller body for a roller, for pressure-treating or temperature-treating or combined pressure- and temperature-treating a web-shaped medium, for example paper, includes a casting body made of an iron-based alloy comprising graphite lamellae. Particular regions of the roller body are placed under tensile stresses during or after production. The stresses being applied are larger than those which occur in these regions during operation of a roller. The additionally applied tensile stresses trigger local plastic deformations in peripheral regions of the graphite lamellae, such that once the tensile stresses are no longer applied, the roller body behaves elastically and no longer permanently deforms up to the stress level achieved.

37 Claims, No Drawings

DIMENSIONALLY STABILIZED ROLLER BODY

FIELD OF THE INVENTION

The invention relates to a roller body for a roller, for pressure-treating and/or temperature-treating a web-shaped medium, for example a paper web or thin metal web, and to a method for manufacturing said roller body. The roller body can in particular be a roller body of a calender roller of a paper machine.

BACKGROUND OF INVENTION

Reports are increasingly occurring that new calender rollers are becoming "bent" in the calender after a certain running time. These are measured central deviations of the order of 0.1 mm or a bend of about 0.05 mm. The fact that in practice such reports only come from rollers provided with a relatively thin hard coating allows the conclusion that this is not a new phenomenon, but that the incidence of bending has only come to the attention of the calender operator due to the thin coating. For, while it has previously been possible to correct such bending by routinely re-grinding—the re-grindable hard shell has had a thickness of over 8 mm—, correcting by grinding for a layer thickness of 0.1 to 0.15 mm practically always means losing the whole, expensive coating.

When a gray casting body—and the core of clear chill casting rollers such as the invention preferably relates to is such a body—is produced, it experiences practically no mechanical loads during the whole production, beyond the load of the weight of the body. This means that even a slight additional load, e.g. due to the swing of the roller body which is mounted at its ends during transport from the manufacturer to the operator, repeatedly triggers additional tensile stresses which cause a slight, permanent deformation of the roller body. Loads can also for example arise if the quick-release mechanism separates the rollers during operation. This is for example the case if the material web to be treated tears and a heated roller in a calender comes into direct contact with a roller comprising an elastic coating. A specific mechanism then separates the rollers and the rollers fall downwards, where they are collected by a device. This exerts acceleration forces of up to 2 g on the rollers.

Consider the order of magnitude: rollers are produced for example with a diameter of 812 mm and a roller length of 9,000 mm with a production tolerance of 0.005 mm with respect to the concentricity precision. In the case of a hard coating or chromium plating, a layer thickness of 0.15 mm is usually applied. A bend of 0.05 mm means a concentricity error of 0.1 mm, i.e. a deterioration in the tolerance by a factor of 20. At high rotational speeds, this incurs an imbalance and additional excursion.

SUMMARY OF THE INVENTION

It is an object of the invention to produce a roller body which no longer bends under the loads to be expected.

This object is solved by the subjects of the independent claims. Advantageous developments are described in the dependent claims.

BRIEF DESCRIPTION OF THE INVENTION

The invention is based on the following insight: an analysis of the causes of bending in roller bodies made of gray cast iron leads to a peculiarity of gray cast iron having a laminar formation of the dispersed graphite. As the molten iron is cooled, at temperatures of 1150 to 1300° C., the carbon dissolved in the iron is dispersed in a laminar formation. In the course of further cooling, the material shrinks, causing significantly increased stresses locally at the ends of the lamellae. Additionally superimposing a tensile stress, even at a very low tensile stress level, is enough to cause plastic deformation in these local stress centers, which causes a slight, undesired change in the form of the casting body as a whole.

A roller body in accordance with the invention was subjected to a load in accordance with the invention, in the course of production or afterwards, said load leading to stresses in the roller body which are larger than those which have to be expected in subsequent operation, or during transport. The load leads to plastic deformations in the peripheral regions of the graphite lamellae which are then normally not exceeded in its subsequent use. Highly pre-stressed regions around the ends of the lamellae are loaded beyond the elastic limit by means of an additional stress, such that they are plastically deformed. If the roller body is relaxed again from this additional stress, the pre-stress is reduced to the difference between the elastic stress limit and the stress additionally applied by way of the treatment in accordance with the invention. The roller body's own stress has been reduced. In order to elastically deform the roller body again, an additional stress must be applied which goes beyond the "training stress", i.e. beyond the additional stress applied within the framework of the treatment in accordance with the invention. If the additional stress applied within the framework of the treatment in accordance with the invention has been selected high enough, then the roller body can no longer be plastically deformed during subsequent operation. As a result, selectively determined regions of the roller body are placed under an additional stress. A roller body which has already got these deformations over with during production, subsequently behaves almost completely elastic under normal loads. Such a roller body can no longer be permanently deformed, but rather elastically returns when relaxed. It is dimensionally stabilized.

Stabilizing in accordance with the invention is performed once the casting body has been cast and solidified. It can be performed before or after a surface treatment, for example coating or grinding, of the roller body. It can also be used to correct a plastic deformation which has already occurred, i.e. for straightening.

The inner stresses can be generated in various ways. The stresses are preferably applied mechanically or thermally or mechanically and thermally in combination.

In a preferred mechanical treatment, the roller body or roller is held fast at its ends, e.g. clamped in a lathe. By exerting a pressure, preferably directed radially to the retarded rotational axis of the roller body, onto the roller body in its axial center, the roller body is bent, and stresses are therefore generated in the roller body. This pressure is expediently applied from above, because the stresses generated in this way are added to those already generated by the roller body's own weight. If the pressure is applied from the side, then the actual load on the roller body follows from the force diagram. A load from below must first balance out twice the roller body's own weight before there is an additional load. Here, it should be taken into account that a load localized approximately in the center generates a stress which is approximately 1.6 times larger than an equivalent linear load distributed evenly over the roller barrel.

If the load is applied by one or more pressure bodies, e.g. by a hydraulically pressed roll, then the roller body ejected by it can be rotated while loaded. The plastic deformations at the ends of the graphite lamellae roll back asymptotically, such that the material structure or roller body is stabilized after only a few revolutions. Attention must be paid here to Herz' pressing, generated by the roll in the roller material, in order that the roller body itself is not damaged.

Instead of continuous rotation, it is also possible to apply the load to a stationary roller body. In this treatment, the roller body is preferably rotated a little further after each load. It can, for example, be rotated by approximately 30° each time. Such a repeated, static load has the advantage that the pressure can be applied using a molded piece adapted to the roller barrel. This reduces the specific surface load. The type of treatment is also advantageous for roller bodies which already have a ground surface and/or are already coated, to retro-stabilize them.

If a roller body is already bent, the sag can be corrected before or after a stabilizing treatment, by redressing the roller into a position by applying a corresponding force.

Using the invention, a roller body which has become bent during use, i.e. through operating the roller, can advantageously be straightened mechanically by returning the roller body to a position by applying a force which redresses it into a straight shape. The redressing force can be applied as described above with respect to stabilizing. The roller body is preferably straightened in a number of steps differentiated according to the size of the redressing force. In a first step, the roller body is bent back using a preliminary force. The preliminary force is between 30 and 70%, for example 50%, of the force ultimately required to bend the bent roller body back into its straight shape. The preliminary force is then increased in stages or possibly continuously up to the force required to bend the roller body back into its straight shape. If, while being straightened, the roller body is bent in a direction perpendicular to the redressing force, the direction of the redressing force can be correspondingly changed with respect to the roller body. The extent of such undesired bending is, however, negligibly small as compared to the bending of the roller body before it is straightened.

The stresses in accordance with the invention can likewise be generated by generating a temperature difference. If the tensile stress in the course of such a thermal treatment reaches a level all over which goes beyond what can be expected in the roller's subsequent lifetime, then stabilizing in the sense of the invention using a heat treatment is also possible.

In the case of a thermal treatment, a temperature gradient is preferably generated in the radial direction in the roller body.

The temperature difference dt for generating a local tensile stress X is set at the location of said tensile stress such that it exhibits the value:

$$dt=X/(a\times E)$$

as compared to the remaining roller average, where a is the thermal expansion coefficient and E is the modulus of elasticity of the material of the roller body.

The stresses are generated in such a way that they are balanced out over the sum of the roller cross-section. Tensile and compressive stresses automatically counterbalance. Preferably, all regions of the roller body's cross-section are placed under tensile stresses using a number of consecutive thermal treatments.

In a preferred thermal treatment, a hollow-cylindrical roller body is heated from without and within by rapidly heating it in a furnace for thermal annealing treatments comprising a strong inner blast, such that tensile stresses arise in the radial center of the roller body wall, because this region only absorbs the temperature with a time lag. By then cooling the soaked roller body by means of an inner and outer temperature drop, the stress profile is inverted. Regions experiencing compressive stresses during heating are exposed to tensile stresses during cooling. This treatment is repeated one or more times as appropriate.

Such temperature differences and a heat transfer fluid flowing though the roller body can also be generated by accelerated heating followed by forced cooling when operable by means of a heating and cooling facility. However, there is a danger here of destroying the roller body, in particular in the cooling phase. For, by introducing peripheral bores into the roller body, chamfers are generated in the vicinity of the center of the roller body, because the bores running towards each other never meet exactly. These chamfers, harmless in the heating operation—the region is generally experiencing compressive stresses—represent a highly sensitive point for the cooling operation.

A thermal treatment can also be advantageously used to correct a sag which is already present. For this purpose, the roller body is preferably heated or cooled, or also heated and cooled in combination, on one side only. In this way, stresses can be specifically generated in a desired direction. Lastly, reference is made to be fact that, as already mentioned with respect to stabilizing, a thermal treatment can also be used in combination with a mechanical treatment for the purpose of straightening.

Straightening in accordance with the invention, whether purely mechanical, purely thermal, or thermomechanical, is likewise preferably performed in such a way that plastic deformations of the roller body in its subsequently to be resumed operation are counteracted in the same sense as described with respect to stabilizing in accordance with the invention.

The mechanical method exhibits advantages as compared to the thermal treatment. The desired effect is achieved more rapidly and at lower cost. Moreover, the type of load corresponds precisely to that which also leads to the described dimensional defects in the roller body's subsequent lifetime. In subsequent roller body operation, thermal loads occur almost exclusively symmetrically, because the roller is then rotating.

What is claimed is:

1. A roller body for a roller, for pressure-treating or temperature-treating or combined pressure- and temperature-treating a web-shaped medium wherein said roller body is a casting body made of an iron-based alloy comprising graphite lamellae, wherein particular regions of the roller body are placed under tensile stresses during or after production of the roller body, said stresses being larger than those which occur in these regions during operation of the roller, wherein the applied tensile stresses trigger local plastic deformations in the peripheral regions of the graphite lamellae, such that once the tensile stresses are no longer applied, the roller body behaves elastically and no longer permanently deforms, up to the stress level achieved.

2. The roller body as set forth in claim 1, wherein the tensile stresses applied are rotationally symmetrical with respect to a rotational axis of the roller body.

3. The roller body as set forth in claim 1, wherein a state of inner stresses of the roller body, defined by the tensile stresses applied, corresponds to a state of stresses which is achieved when a bending load is applied to the cast roller body, said load being at least 1.5 times larger than a bending load caused by the roller body's own weight under gravity.

4. The roller body as set forth claim 3, wherein said bending load applied to the cast roller body is applied successively and symmetrically about the rotational axis of the roller body.

5. The roller body as set forth in claim 3, wherein the inner stresses are smaller than inner stresses which follow from an apparent yielding point ($\sigma_{0.2}$ limit).

6. The roller body as set forth in claim 1, wherein said web-shaped medium is paper.

7. A method for manufacturing a roller body for pressure-treating or temperature-treating or combined pressure- and temperature-treating a web-shaped medium, wherein:

the roller body is cast from an iron-based alloy containing carbon; and once solidified, exhibits a material structure comprising graphite lamellae, wherein particular regions of the roller body are placed under tensile stresses during or after production, said stresses being larger than those which occur In these regions during operation of the roller and causing the roller body, once the tensile stresses are no longer applied, to behave elastically and to no longer permanently deform, up to the stress level achieved by the tensile stresses.

8. The method as set forth in claim 7, wherein, in order to apply the tensile stresses, the roller body is subjected to a bending load which is at least 1.5 times larger than a bending load caused by the roller body's own weight under gravity.

9. The method as set forth in claim 8, wherein the bending load is at least twice as large as the bending load caused by the roller body's own weight under gravity.

10. The method as set forth in claim 9, wherein the bending load is at least three times as large as the bending load caused by the roller body's own weight under gravity.

11. The method set forth in claim 8, wherein the applied bending load is distributed evenly about a rotational axis of the roller body.

12. The method as set forth in claim 11, wherein the applied bending load is distributed symmetrically about a rotational axis of the roller body.

13. The method as set forth in claim 8, wherein the bending load, as viewed in the longitudinal direction of the roller body, is applied symmetrically with respect to a central transverse axis of the roller body.

14. The method as set forth in claim 7, wherein the roller body is mounted at the ends of the roller body in a mounting device and wherein a pressure body is pressed against the roller body in order to apply a bending load.

15. The method as set forth in claim 14, wherein the pressure body is rotationally mounted and rotates on the roller body, partially or completely around a rotational axis of the roller body.

16. The method as set forth in claim 15, wherein the pressure body is pressed constantly against the roller body as the roller body is rotated.

17. The method as set forth in claim 16, wherein the pressure body is pressed with a constant force against the roller body as the roller body is rotated.

18. The method as set forth in claim 16, wherein the pressure body rotates at a constant speed.

19. The method as set forth in claim 14, wherein the roller body is rotationally mounted in the mounting device.

20. The method as set forth in claim 19, wherein the roller body is rotationally driven.

21. The method as set forth in claim 14, wherein the roller body and the pressure body are at rest relative to each other when the pressure body is pressing against the roller body.

22. The method as set forth in claim 21, wherein the pressure body is pressed against the roller body at a number of pressure points arranged in an even distribution about a rotational axis of the roller body, and is disengaged from the roller body between two adjacent pressure points.

23. The method as set forth in claim 22, wherein the pressure body is pressed against the roller body at a number of pressure points arranged in a symmetrical distribution about a rotational axis of the roller body, and is disengaged from the roller body between two adjacent pressure points.

24. The method as set forth in claim 7, wherein dimensionally stabilizing inner stresses are applied for straightening a bent roller body by applying a bending force to the roller body, on one side only.

25. The method as set forth in claim 24, wherein the bending force is increased in stages or continuously during straightening.

26. The method as set forth in claim 7, wherein the roller body is subjected to a thermal treatment for applying inner stresses, said treatment generating tensile stresses of the locally different sizes in the roller body's cross-section.

27. The method as set forth in claim 26, wherein the treatment generates alternating tensile stresses of the locally different sizes in the roller body's cross-section.

28. The method as set forth in claim 26, wherein said tensile stresses equal the inner stresses in their effect, due a the bending load which is at least 1.5 times larger than a bending load caused by the roller body's own weight under gravity.

29. The method as set forth in 26, wherein the thermal treatment is performed in an annealing furnace.

30. The method as set forth in claim 26, wherein a radial temperature gradient is generated in the roller body.

31. The method as set forth in claim 26, wherein the thermal treatment is performed by externally heating the roller body, wherein the roller body is stationary or is rotationally driven.

32. The method as set forth in claim 31, wherein the thermal treatment is performed by means of radiant heaters.

33. The method as set forth in claim 26, wherein the thermal treatment is performed by cooling an axial central bore of the roller body using a cooling medium.

34. The method as set forth in claim 33, wherein said cooling medium is dry ice.

35. The method as set forth in claim 33, wherein the roller body is rotationally driven.

36. The method as set forth in claim 7, wherein inner stresses applied after casting by retro-treating fall significantly below inner stresses which would be achieved by reaching an apparent yielding point ($\sigma_{0.2}$ limit) of the roller body material.

37. The method as set forth in claim 7, wherein dimensionally stabilizing inner stresses are applied by heating or cooling the roller body on one side only for straightening a bent roller body.

* * * * *